US005796076A

United States Patent [19]

Azuma

[11] Patent Number: 5,796,076

[45] Date of Patent: Aug. 18, 1998

[54] SAUNA HEATER CONTROL

[76] Inventor: Yoshihiko Azuma, 6-28, Nakajima-cho, Nishinomiya-shi, Hyogo, Japan

[21] Appl. No.: 542,558

[22] Filed: Oct. 13, 1995

[30] Foreign Application Priority Data

Jan. 9, 1995 [JP] Japan ..... 7-001511

[51] Int. Cl.[6] ..... H05B 1/02

[52] U.S. Cl. ..... 219/486; 219/484; 219/501; 219/510; 307/39

[58] Field of Search ..... 219/483–486, 219/491, 481, 505, 501, 508, 509, 497, 499, 510; 307/38–41

[56] References Cited

U.S. PATENT DOCUMENTS 4,085,309 4/1978 Godel et al. ..... 219/364
4,112,281 9/1978 Epps ..... 219/283
4,547,658 10/1985 Crowley ..... 219/539
4,851,646 7/1989 Perala ..... 219/483
4,886,955 12/1989 Kimura ..... 219/494
4,990,752 2/1991 Worall et al. ..... 219/501

*Primary Examiner*—Mark H. Paschall
*Attorney, Agent, or Firm*—Schweitzer Cornman Gross & Bondell LLP

[57] ABSTRACT

A sauna heater control having a plurality of electrical heater elements for heating a sauna chamber, an alternating current heater power circuit, a half-wave rectifier for selective inclusion in the alternating current heater power circuit, a plurality of circuits for connecting the electrical heater elements and the half-wave rectifier in various conductive pathways in the alternating current heater power circuit, and a switch for switching the electrical heater elements and the half-wave rectifier between the various conductive pathways.

4 Claims, 5 Drawing Sheets

SAUNA HEATER CONTROL

FIELD OF THE INVENTION

The present invention relates to a heater for an electrically heated sauna having an infrared radiator.

BACKGROUND OF THE INVENTION

Sauna equipment is in general designed to raise the temperature in a sauna chamber considerably above 60° C. to stimulate perspiration. There is some danger to persons of advanced age or to sick persons of more than tolerable physical strain. For this reason, a type of sauna equipment has been developed utilizing infrared irradiation of the user in the far infrared range. This is also available to clothed persons. The chamber is kept at a relatively low temperature of about 40° C. so that the users do not perspire, while the thermal effect of the infrared radiation from the heater causes cellular activation of the user.

When a conventional sauna heater for high temperature exposure is utilized for infrared exposure at a relatively low temperature usually the power to the heater is switched on and off to maintain the temperature of the chamber at a temperature, desirably as low a control temperature as about 40° C. However, the temperature in the chamber pulsates up and down with reference to the set control temperature due to the high heating capacity of the heater, so that the user cannot enjoy comfortable infrared irradiation. Since the heater is deenergized for relatively long periods while its surface temperature decreases the infrared rays, no infrared radiation is emitted during such cooling periods and thus the user is not continuously irradiated.

Furthermore, in such cases a plurality of heaters are required for uniform heating of the chamber, which in turn require a method of controlling the temperature in the chamber by varying the number of heaters that are radiating at any given time. Therefore, in this case in addition to the aforementioned problem of prolonged shutdowns, the differential wear of the heaters presents an additional problem.

One method of switching heater power on and off is disclosed in Japanese Unexamined Utility Model Application Publication No. S60-15333, describing a control method for reducing the heat while supplying current to the heater, that is reduced by a half by half-wave rectification of the AC power when the temperature in the chamber reached the set control temperature. In this control method, the temperature in the chamber is maintained effectively at the control temperature while the heater is constantly energized during high temperature exposure where the control temperature is above 60° C. However, when the control temperature is set below 50° C., such as at a low temperature of about 40° C., the extent of heating of the 50%reduced high capacity heater cannot be sufficiently reduced even when counting on a certain amount of heat loss radiated to the outside of the chamber. In this case, the temperature in the chamber will be higher than the control temperature, and low temperature infrared irradiation cannot be employed.

In the control method, where the electric current supplied to the heater is reduced merely by 50% above the control temperature, is then fully restored to 100% at a level below the control temperature. Thus, even when the lower heating rate is used and the temperature in the chamber can be maintained relatively low while constantly energizing the heater, a pulsating change of temperature inside the chamber takes place about the control temperature. This pulsation is increased due to the ambient temperature outside the chamber being different in the summer and the winter. Therefore the user cannot achieve comfortable and effective infrared irradiation effect.

SUMMARY OF THE INVENTION

It is, therefore, an object of the present invention gradually to reduce the total power consumption of all heaters to about one-tenths of heater capacity even in high temperature-type sauna equipment wherein the usual total power consumption of all heaters is large, enabling good maintenance of the temperature in a chamber at a relatively low set control temperature (referred to hereinafter as "THs") of 40° C. to 50° C., which can otherwise not be realized by a conventional half-wave/full-wave switching method.

It is another object of the present invention to keep all heaters constantly radiating far infrared rays even at a relatively low temperature, not by switching on and off the power circuit of the heaters, but by gradually reducing and increasing their heating rate while continuing to energize all heaters at all times.

It is a further object of the present invention to control heating while energizing all heaters continuously under the same condition, thereby deleting variations for appreciable periods of time between the heaters.

It is still a further object of the present invention to enable irradiation of a user in the far infrared which requires a relatively low control temperature usually about 40° C., to avoid causing perspiration of the user, by employing high temperature sauna equipment, enabling comfortable and effective low temperature infrared irradiations.

The foregoing objectives and others are achieved in accordance and the present invention in a sauna heater control which comprises a plurality of electrical heater elements for heating a sauna chamber, an alternating current heater power circuit, a half-wave rectifier for selective inclusion in the alternating current heater power circuit, a plurality of circuits for connecting the electrical heater elements and the half-wave rectifier in various conductive pathways in the alternating current heater power circuit, and a switch for switching the electrical heater elements and the half-wave rectifier between said various conductive pathways. Some of the conductive pathways include the half-wave rectifier, and some other of the conductive pathways do not include the half-wave rectifier. A first set of said conductive pathways disposes the electrical heater elements in parallel, and a second set of conducting pathways disposes the electrical heater elements in series, whereby the power consumption of the electrical heater elements differs depending on whether the half-wave rectifier is within the heater circuits, and whether the first set or second set of conductive pathways is employed.

BRIEF DESCRIPTION OF THE DRAWINGS

While the novel features of the invention are set forth with particularly appended claims, the invention will be better understood and appreciated from the following detailed description with reference being had to the drawing, wherein

DETAILED DESCRIPTION OF THE PREFERRED EMBODIMENTS embodiments

Figure 1:
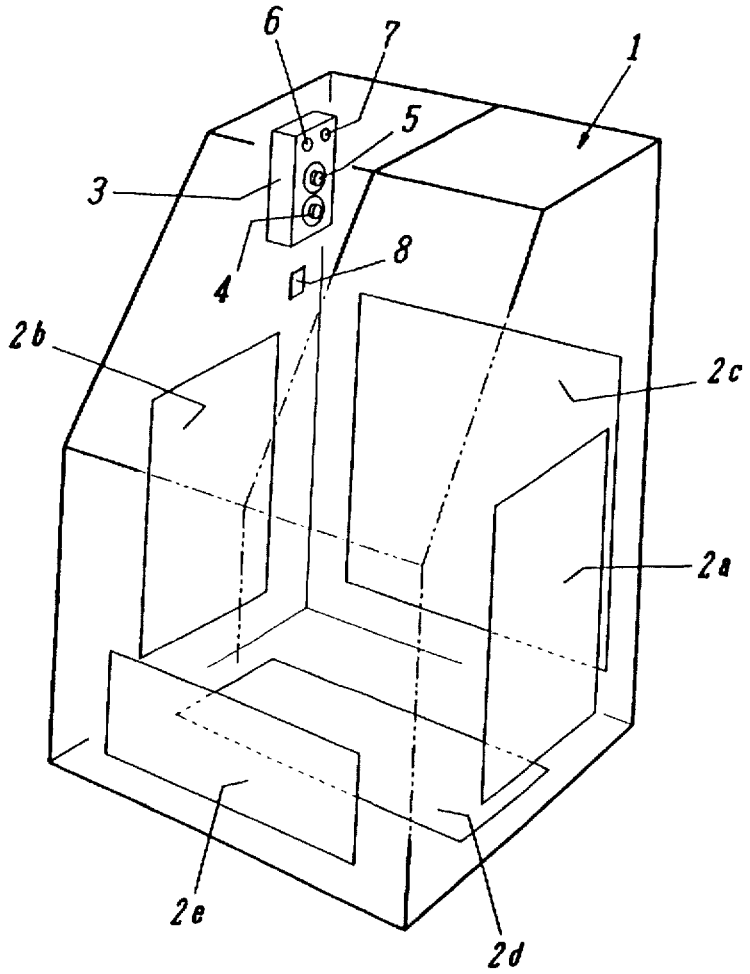
FIG. 1 is a schematic perspective view showing a configuration of simple collapsible sauna chamber.

In FIG. 1 a simple collapsible sauna chamber includes heaters 2*a*, 2*b* located at both side faces in the assembled chamber, a heater 2*c* located at a back face, a heater 2*d* located on a floor and a heater 2*e* located at a lower front face. If need be, a chair, a backboard and a floor drainboard (not shown in the drawing) can be employed in the chamber. It is to be understood that the sauna equipment is not restricted to the herein illustrated simple collapsible type of sauna equipment 1, but it may be a cabinet-style sauna chamber with a door.

The heaters 2*a* to 2*e* are plate-type heaters, such as of carbon layer covered glass with an insulating layer such as an epoxy resin. In FIG. 1, the heater plates are schematically shown as disposed on respective faces of the chamber. Suitably an even number of heaters are employed to limit any unevenness in temperature distribution. Thus, for example, 8 to 10 heating plates are suitably employed, suitably having the same capacity. The heating units or specific selected heating units are suitably provided with temperature fuses.

A controller 3 is disposed at a suitable location in the chamber. This controller 3 accommodates main parts of a heater control apparatus of the present invention, a control temperature adjuster 4, a timer 5 for setting the heating time (on/off timer for the power source), a power-on indicator lamp 6, a temperature indicator lamp 7, a leakage breaker, and other elements as required. Furthermore, a temperature sensor 8 connected to the controller 3 is disposed at a suitable location in the chamber. The temperature indicator lamp 7 is lit whenever the temperature in the chamber measured by the temperature sensor 8 reached the control temperature set by the adjuster 4, or otherwise programmed independently of the adjuster 4.

Figure 2:
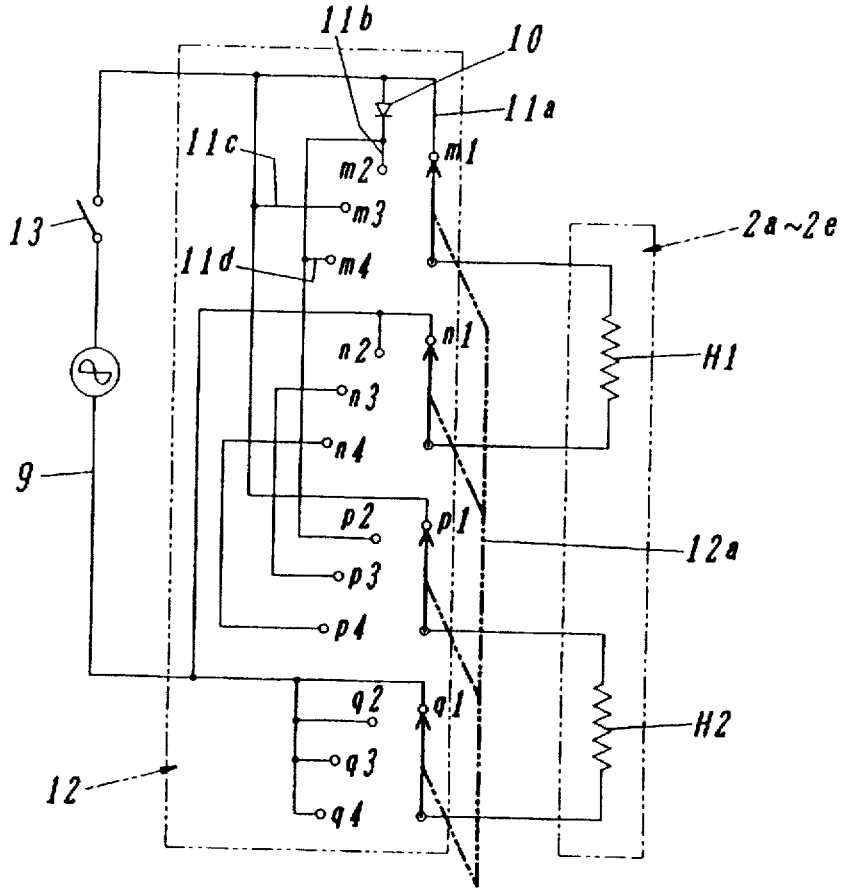
FIG. 2 is a circuit diagram illustrating a basic configuration of a shifting switch associated with two heaters.

FIG. 2 explains a basic configuration of the heater control apparatus of the present invention, assuming that the heaters 2*a* to 2*e* in the chamber are two plate heaters H1, H2 for the purpose of simplification. In an AC power circuit 9 common to the heaters H1, H2 through a power switch 3, there are provided a half-wave rectifier 10, four connecting circuits 11*a*–1*d* between the heaters H1, H2 and the AC power circuit 9, and a circuit shifting switch 12. The connecting circuits include the first connecting circuit 11*a* connecting the two heaters H1, H2 in parallel to the AC power circuit 9 as shown in (A) of FIG. 3, the second connecting circuit 11*b* connecting the two heaters H1, H2 in parallel to the AC power circuit 9 through the half-wave rectifier 10 as shown in (b) of FIG. 3, the third connecting circuit 11*c* connecting the two heaters H1, H2 in series to the AC power circuit 9 as shown in (C) of FIG. 3, and the fourth connecting circuit lid connecting the two heaters H1, H2 in series to the AC power circuit 9 through the half-wave rectifier 10 as shown in (D) of FIG. 3.

The circuit shifting switch 12 is suitably a 4-gap 4-stage rotary switch 12*a* and is wired to the AC power circuit 9, the heaters H1, H2, and the half-wave rectifier 10 so that the first connecting circuit 11*a* (A of FIG. 3) is formed by establishing contacts ml, n1, p1, q1 in respective stages in the rotary switch 12*a*. The second connecting circuit 11*b* (B of FIG. 3) is formed by establishing second contacts m2, n2, p2, q2 is respective stages. The third connecting circuit 11*c* (C of FIG. 3) is formed by establishing third contacts m3, n3, p3, q3 in respective stages and the fourth connecting circuit 11*d* (D of FIG. 3) is formed by establishing fourth contacts m4, n4, p4, q4 in respective stages.

Assuming that the capacity of each of the two heaters H1, H2 is 1 KW and the voltage of the power circuit 9 is 100 V, when the heaters H1, H2 are connected to the AC power circuit 9 through the first connecting circuit 11*a* by the switch 12, an electric current of 10 Amperes is applied to the heaters H1, H2 which are heated by the full electric power of 1 KW, so that the heating capacity of all the heaters 2*a* to 2*e* is 2 KW. When the heaters H1, H2 are connected to the AC power circuit 9 through the second connecting circuit 11*b* shown in (B) of FIG. 3 by the switch 12, the half-wave rectified electric current of 5 Amperes is applied to the heaters H1, H2 which are heated with a power of 500 W, so that the heating capacity of all the heaters 2*a* to 2*e* is 1 KW is 50% of the full power.

Figure 3:
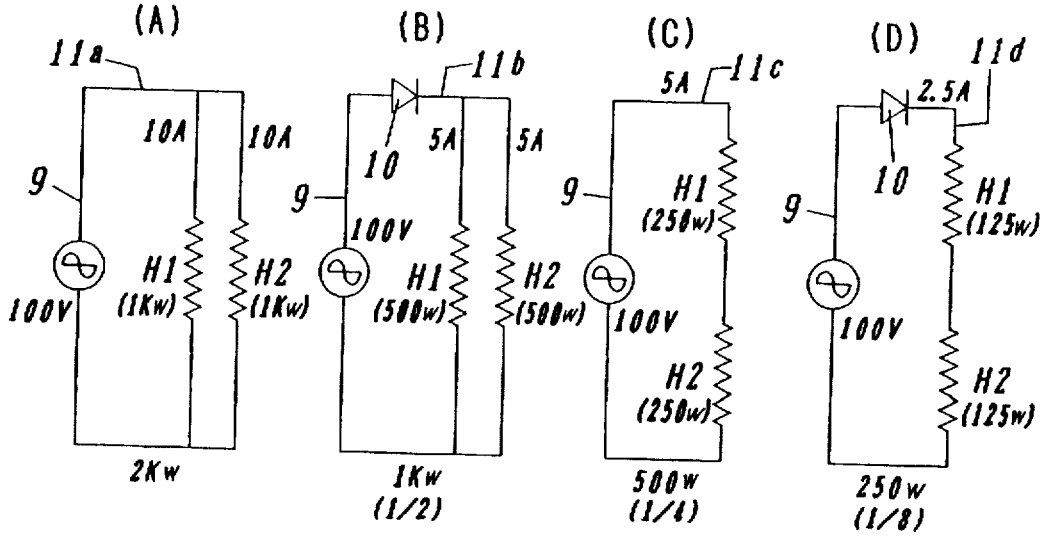
FIG. 3 are circuit details showing four different connecting circuit configurations established by the shifting switch of FIG. 2.

When the heaters H1, H2 are connected to the AC power circuit 9 through the third connecting circuit 11*c* shown in (C) of FIG. 3 by the switch 12, the voltage as well as the electric current applied to the heaters H1, H2 are reduced to half, respectively to 50 V and 5 Amperes, so that the heaters H1, H2 are heated with a power of 250 W and the total heating capacity of the heaters 2*a* to 2*e* is reduced to 500 W corresponding to 25% of the full electric power. Finally, when the heaters H1, H2 are connected to the AC power circuit 9 through the fourth connecting circuit 11*d* shown in (D) of FIG. 3 by the switch 12, a half-wave rectified electric current of 2.5 Amperes is applied to the heaters H1, H2 which are heated with a power of 125 W, so that the total heating capacity of the heaters 2*a* to 2*e* is reduced to 250 W corresponding to 12.5% of the full electric power.

Thus, when the connecting circuits between the heaters H1, H2 and the AC power circuit 9 are switched from one to another by the switch 12, the heating capacity of the heaters 2*a* to 2*e* can be shifted in four stages of 100% , 50% , 25% and 12.5% while energizing the heaters H1, H2 or the heaters 2*a* to 2*e* for heating the chamber at varying rates.

Figure 4:
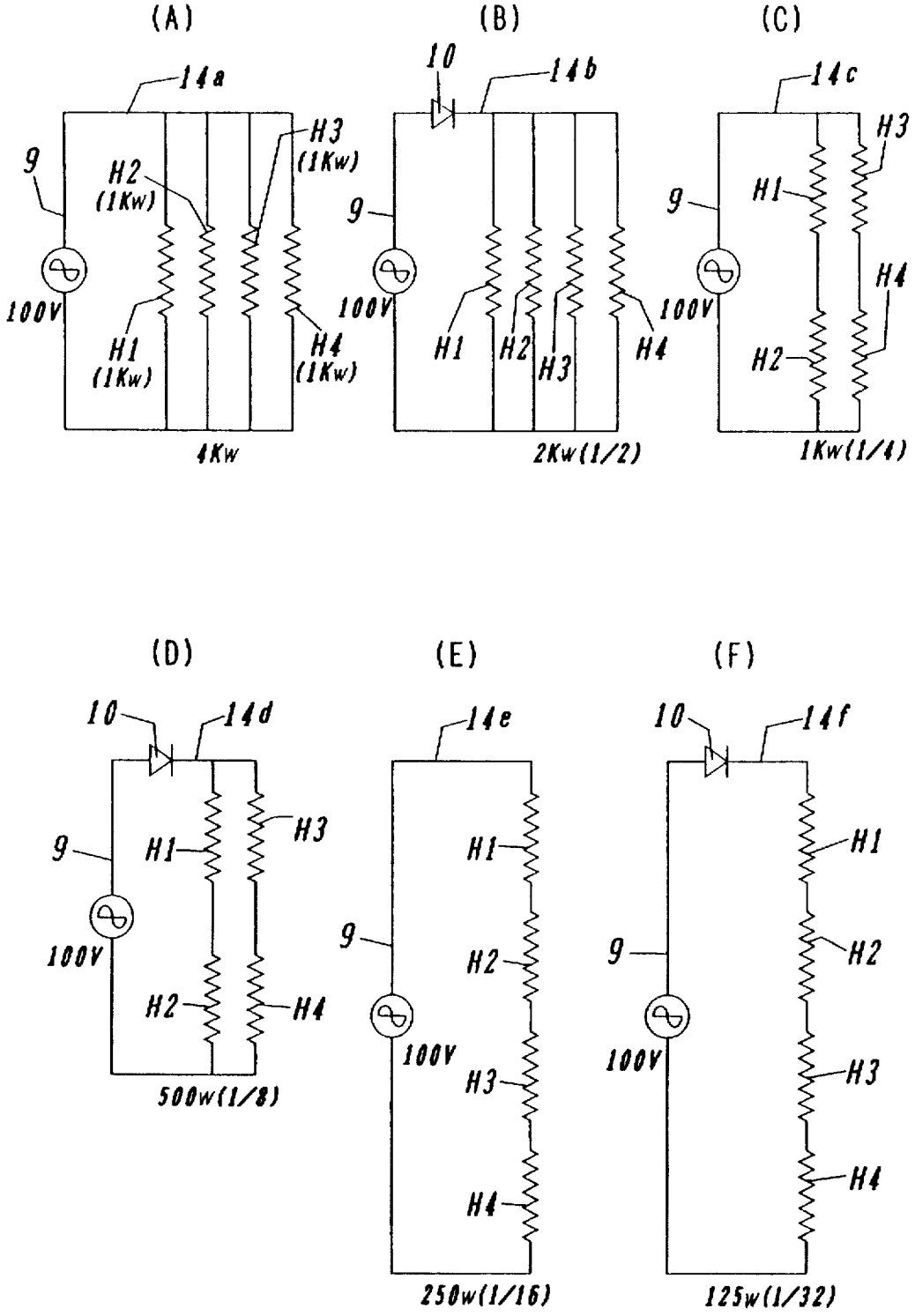
FIG. 4 is a set of circuit diagrams showing connecting circuits for four heaters.

FIG. 4 shows six connecting circuits 14*a* to 14*f*which are selectively switched by the switch 12 associated with the six circuits, assuming that the heaters 2*a* to 2*e* are constituted by the four plate heaters H1 to H4, each of the same capacity. The first connecting circuit 14*a* (A of FIG. 4) connects the four heaters H1 to H4 in parallel to the AC power circuit 9, whereby the full 100% heating capacity is obtained. The second connecting circuit 14*b* (B of FIG. 4) connects the four heaters H1 to H4 in parallel to the AC power circuit 9 through the half-wave rectifier 10, whereby the total heating capacity of the heaters 2*a* to 2*e* is reduced to one half. The third connecting circuit 14*c* (C of FIG. 4) connects the heaters H1, H2 in series and the heaters H3, H4 connected in series to the AC power circuit 9, in parallel, whereby the total heating capacity of the heaters 2*a* to 2*e* is reduced to one quarter.

The fourth connecting circuit 14*d* (D of FIG. 4) is the same as the third connecting circuit 14*c* except that the half-wave rectifier 10 interposed whereby the total heating capacity of the heaters 2*a* to 2*e* is reduced to one eighth. The fifth connecting circuit 14*e* (E of FIG. 4) connects the heaters H1 to H4 in series to the AC power circuit 9, whereby the total heating capacity of the heaters 2*a* to 2*e* is reduced to one sixteenth. Finally, the sixth connecting circuit 14*f* (F of FIG. 4) is the same as the fifth connecting circuit 14*e* except that the half-wave rectifier 10 interposed, whereby the total heating capacity of the heaters 2*a* to 2*e* is reduced to 1/32.

Figure 5:
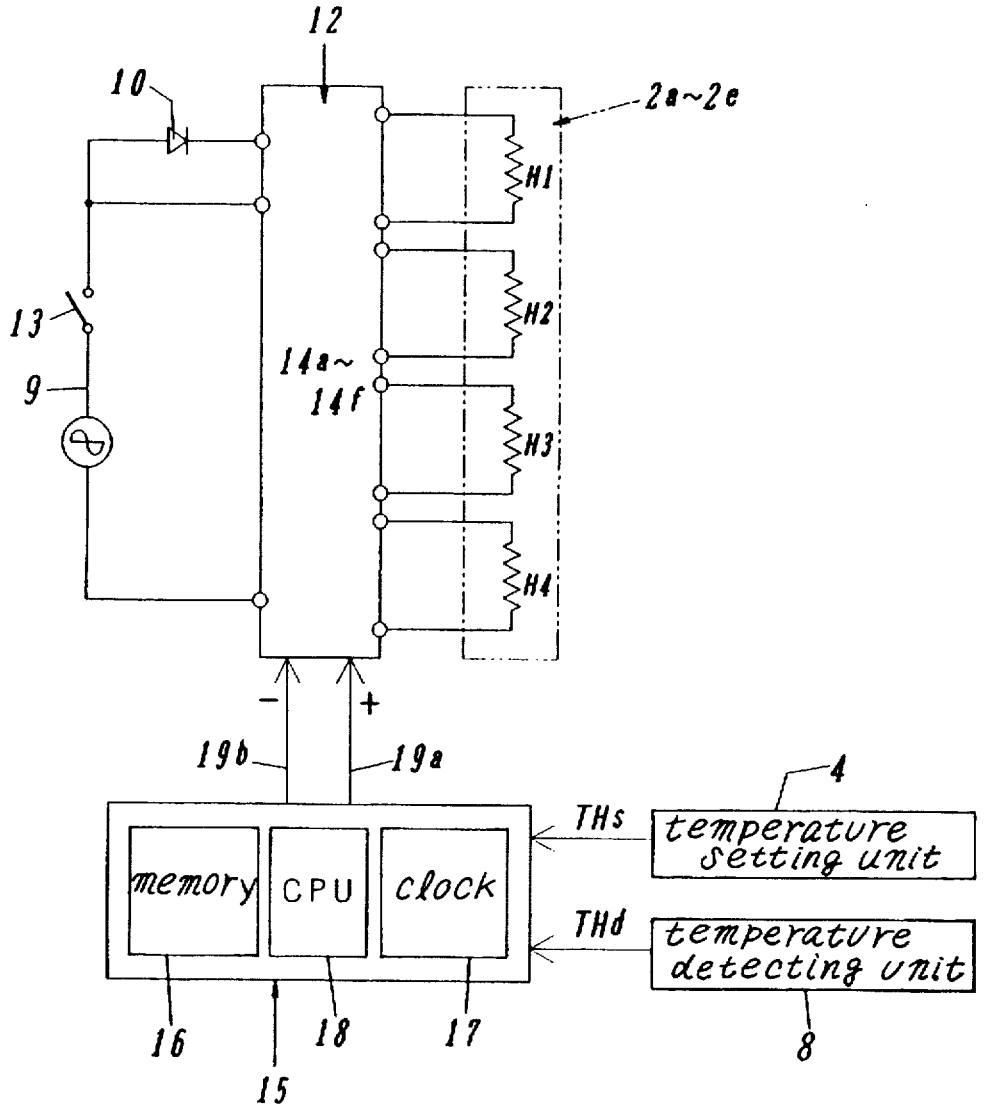
FIG. 5 is a schematic view of an embodiment in which the shifting switch is automatically controlled.

FIG. 5 shows an exemplary arrangement is which the six connecting circuit 14*a* to 14*f* shown in FIG. 4 automatically controlled by the circuit shifting switch 12 associated with a controller 15 which suitably comprises a microcomputer. The control temperature adjuster 4 and the temperature sensor 8 are connected to signal input terminals of the controller 15. When temperature signals exiting from the control temperature adjuster 4 and from the temperature sensor 8 are analog signals an A/D converter (not shown) function is employed in common connected with the control temperature adjuster 4 and the temperature sensor 8.

The controller 15 has an internal memory 16, and internal clock 17 and a central processing unit (CPU) 18. The CPU 18 executes a control program written in the internal memory 16 based on temperature information provided from the control temperature adjuster 4 and the temperature sensor 8 and information on a clock signal of the internal clock 17, and its output is a forward contact shifting adjusting signal 19*a*, and a backward contact shifting actuating signal 19*b* to the switch 12.

The circuit switch 12 shifts the connecting circuit 14*a* to 14*f* to a lower stage in order such as from the first contact to the second contact and from the second contact to the third contact whenever receiving the forward contact shifting actuating signal 19*a*, and shifts the connecting circuit 14*a* to 14*f* to a higher stage in order such as from the sixth contact to the fifth contact and from the fifth contact to the fourth contact whenever receiving the backward contact shifting actuating signal 19*b*. Desirably, a stepping switch circuit with electronic contacts can be employed instead of a rotating switch with mechanical controlling elements.

Figure 6:
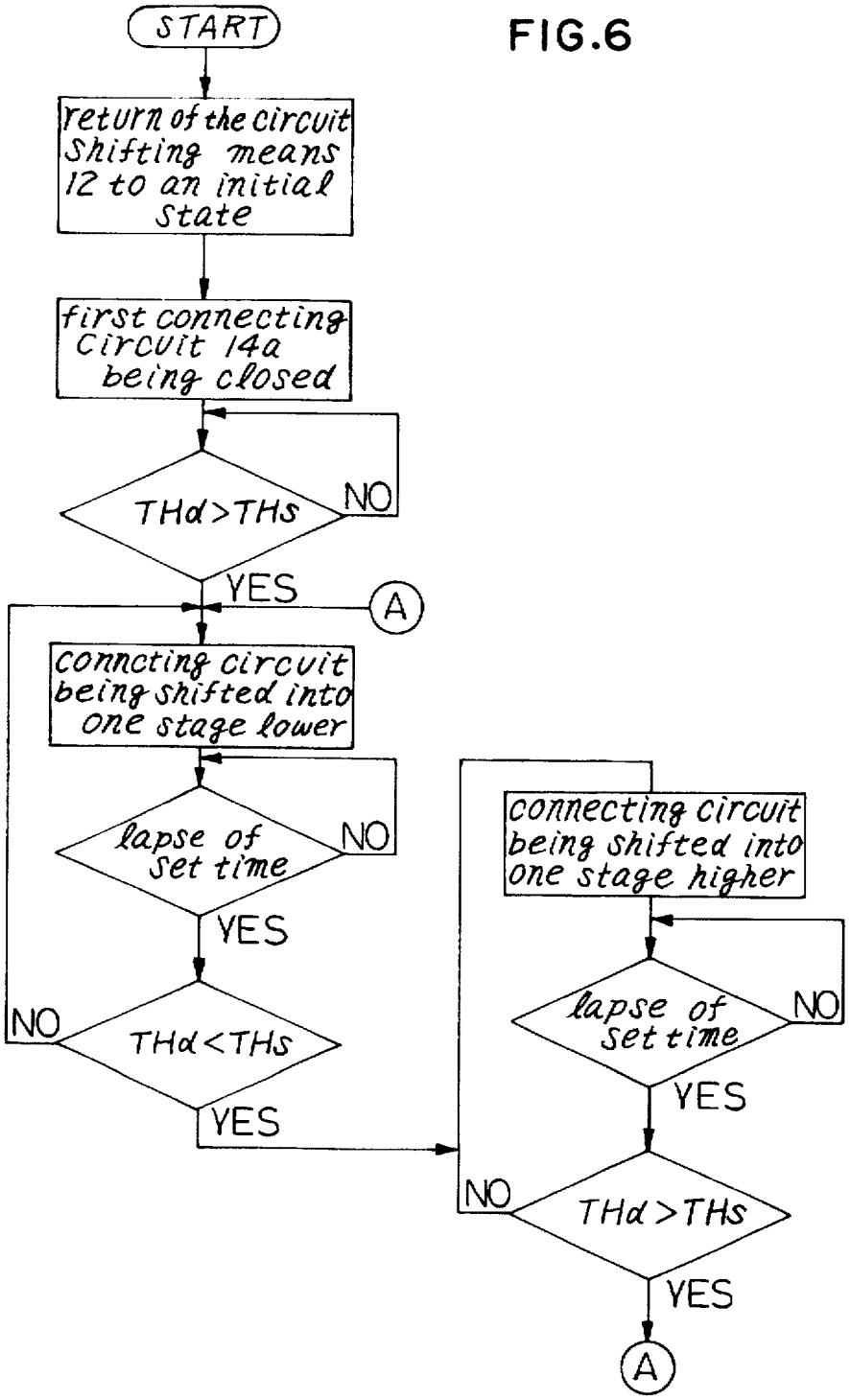
FIG. 6 is a flow chart of a control program.

Suitably the control program is executed by the controller 15 as shown in the flow chart of FIG. 6. When the power switch is turned on and the temperature is set by the control temperature adjuster 4, the controller 15 returns the circuit shifting switch 12 to an initial state, provided that the temperature THd in the chamber detected by the temperature sensor 8 is lower than the set control temperature THs. That is, the first contact is established and the first connecting circuit 14*a* shown in (A) of FIG. 4 is closed, whereby the maximum heating value of the heaters 2*a* to 2*e* is realized and the chamber is rapidly heated.

When the temperature in the chamber rises and the temperature THd detected by the temperature sensor 8 becomes higher than the temperature THs set by the temperature adjuster 4, the controller 15 outputs the forward contact shifting actuating signal 19*a* to the circuit shifting switch 12, which in turn establishes the second contact and opens the first connecting circuit 14*a*, and closes the second connecting circuit 14*b* shown in (b) of FIG. 4. Thus, the total heating capacity of the heaters 2*a* to 2*e* is reduced to one half. Thereafter, the controller 15 compares and calculates the temperature THd detected by the temperature sensor 8 and the set control temperature THs of the temperature adjuster 4 after every passage of a predetermined time period set optionally to last from several seconds to several minutes. Whenever the detected temperature THd is higher than the set control temperature THs, the forward shifting actuating signal 19*a* is outputs to the circuit shifting switch 12, and the connecting circuit is shifted in the order from the second connecting circuit 14*b* to the third connecting circuit 14*c*, and respectively from the third connecting circuit 14*c* to the fourth connecting circuit 14*d*.

When the detected temperature THd becomes higher than the set control temperature THs, the heating capacity of the heaters 2*a* to 2*e* is gradually reduced by the aforementioned operation, thus, the detected temperature THs that each fixed time period, risen in the chamber is suppressed and the temperature in the chamber begins to reduce. For example, assuming that the detected temperature THd becomes lower than the set control temperature THs in a condition where the fifth connecting circuit 14*e* shown in (E) of FIG. 4 is closed and the heating capacity of the heaters 2*a* to 2*e* is reduced to one sixteenth, when the controller 15 detects such a condition, the controller 15 provides outputs the backward contact shifting actuating signal 19*b* to the circuit shifting means 12, which in turn shifts the connecting circuit to the fourth connecting circuit 14*d* which is one stage higher. Thus, the heating capacity of the heaters 2*a* to 2*e* is increased to one eighth thus again to raise the temperature in the chamber.

Thereafter, the controller 15 compares and calculates the temperature THd detected by the temperature sensor 8 and the set control temperature THs of the temperature adjustor 4 after each passing of a fixed time period. Whenever the detected temperature THd is lower than the set control temperature THs, the back-ward contact shifting actuating signal 19*b* is provided to the circuit shifting switch 12, and the connecting circuit is shifted to a higher circuit in the order from the fourth connecting circuit 14*d* to the third connecting circuit 14*c*, and respectively from the third connecting circuit 14*c* to the second connecting circuit 14*b*. Thus, the heating capacity of the heaters 2*a* to 2*e* is gradually increased to raise the temperature in the chamber. And, for example, assuming that the detected temperature THd then again becomes higher than the set control temperature THs in a condition where the third connecting circuit 14*c* shown in (C) of FIG. 4 is closed and the heating capacity of the heaters 2*a* to 2*e* is one half, when the controller 15 detects such a condition, it outputs the forward contact shifting actuating signal 19*a* to the circuit shifting switch 12, which in turn shifts the connecting circuit to the fourth connecting circuit 14*d* which is one stage lower. This, the heating capacity of the heaters 2*a* to 2*e* is increased to one quarter and the temperature in the chamber starts to rise again.

The temperature in the chamber can be thereafter stabilized in the vicinity of the set control temperature by repeating the aforementioned operations. At lower control temperatures the fourth to sixth connecting circuits 14*d* to 14*f* are capable of reducing the heating capacity of the heaters 2*a* to 2*e* to maintain a gentle temperature variation gradient in the chamber. In other words, even in the case of sauna equipment with the heaters 2*a* to 2*e* having the heating capacity to be set, for example, up to 80° C., the control temperature can be set as low as about 40° C. and the temperature in the chamber can be stabilized in the vicinity of about 40° C. while continuously energizing all of the heaters 2*a* to 2*e*.

When the chamber heaters 2*a* to 2*e* are the four heaters H1 to H4 which have the same heating capacity as described above, the total heating capacity of the heaters 2*a* to 2*e* can be switched in six stages to 1/32 since the connecting circuits 14*a* to 14*f* are switched from one to another by the circuit shifting switch 12. In practice, the heaters 2*a* to 2*e* can be constituted of 8 to 10 plate heaters, so that it is possibly further to smooth the temperature variation gradient in the chamber when the control temperature is lowered, by increasing the shifting stages of the total heating capacity of the heaters 2*a* to 2*e*, this further reducing the minimum heating capacity.

According to the present invention, at least after the temperature (THd) in the chamber detected by the temperature sensor 8 reaches the set control temperature (THs), the controller 15 compares the detected temperature (THd) and the set control temperature (THs) after the lapse of each fixed time period, and the when controller 15 finds that the detected temperature (THd) is higher than the set control temperature (THs), the connecting circuit is shifted by the switch 12 to reduce the total power consumption of the heaters by one stage, and, when the detected temperature (THd) is lower than the set control temperature (THs), the connecting circuitry is shifted by the switch 12 to increase the total power consumption of the heaters of one stage. Therefore, the connecting circuits can be automatically switched to stabilize the temperature in the chamber of the set control temperature merely by setting the desired temperature in the chamber, and this realizing a convenient automatic heater control in a sauna.

Although the present invention has been described in terms of certain preferred embodiments, it is to be understood that such disclosure is not to be interpreted as limiting, because various alterations and modifications will become apparent to those skilled in the art after having read the above disclosure. Accordingly, the appended claims cover all alterations and modifications as fall within the spirit and scope of the invention.

I claim:

1. A sauna heater control which comprises a plurality of electrical heater elements for heating a sauna chamber, an alternating current heater power circuit, a half-wave rectifier for selective inclusion in said alternating current heater power circuit, a plurality of circuits for connecting said electrical heater elements and said half-wave rectifier in various conductive pathways in said alternating current heater power circuit, a switch for switching said electrical heater elements and said half-wave rectifier between said various conductive pathways, means for setting the desired temperature in said sauna chamber, a temperature sensor for measuring the temperature in said sauna chamber, and a controller for regulating the heating of said electrical heater elements and for automatically changing said conductive pathways with said switch by increasing or decreasing the total power consumption of said electrical heater elements in response to said temperature sensor sensing the temperature, and comparing at preselected time intervals the sauna chamber temperature measured by said sensor (THd) with the desired temperature set by said means for setting (THs), wherein some of said conductive pathways include said half-wave rectifier, and some other of said conductive pathways do not include said half-wave rectifier, and wherein a first set of said conductive pathways disposes said electrical heater elements in parallel, and a second set of conductive pathways disposes said electrical heater elements in series, whereby the total power consumption of said electrical heater elements differs depending on whether said half-wave rectifier is within the heater power circuit, and whether said first set or said second set of conductive pathways is employed.

2. The sauna heater control of claim 1, wherein said total power consumption is increased when THd<THs, and said total power consumption is decreased when THd>THs.

3. The sauna heater control of claim 1, wherein said switch is a rotary switch.

4. The sauna heater control of claim 1, wherein said switch is a contact-less stepping switch.

* * * * *